US008870676B2

(12) United States Patent
Takeuchi

(10) Patent No.: US 8,870,676 B2
(45) Date of Patent: Oct. 28, 2014

(54) GOLF CLUB

(75) Inventor: Hiroyuki Takeuchi, Kobe (JP)

(73) Assignee: SRI Sports Limited, Kobe (JP)

( * ) Notice: Subject to any disclaimer, the term of this patent is extended or adjusted under 35 U.S.C. 154(b) by 24 days.

(21) Appl. No.: 13/311,818

(22) Filed: Dec. 6, 2011

(65) Prior Publication Data

US 2012/0165109 A1 Jun. 28, 2012

(30) Foreign Application Priority Data

Dec. 27, 2010 (JP) ..... 2010-290617

(51) Int. Cl.

| | |
|---|---|
| ***A63B 53/16*** | (2006.01) |
| ***A63B 53/06*** | (2006.01) |
| ***A63B 53/14*** | (2006.01) |
| ***A63B 59/00*** | (2006.01) |
| *A63B 53/04* | (2006.01) |

(52) U.S. Cl.

CPC ..... *A63B 53/06* (2013.01); *A63B 53/145* (2013.01); *A63B 2053/0491* (2013.01); *A63B 59/0074* (2013.01); *A63B 59/0092* (2013.01)

USPC ..... 473/297

(58) Field of Classification Search

USPC ..... 473/297

See application file for complete search history.

(56) References Cited

U.S. PATENT DOCUMENTS

| | | | | |
|---|---|---|---|---|
| 4,936,586 | A * | 6/1990 | Van Raemdonck | 473/519 |
| 5,299,807 | A | 4/1994 | Hutin | |
| 7,481,716 | B1 * | 1/2009 | Johnson | 473/297 |
| 2004/0038762 | A1 | 2/2004 | Okamoto | |
| 2006/0063618 | A1 | 3/2006 | Okamoto | |
| 2006/0270488 | A1 * | 11/2006 | Takeuchi | 473/300 |
| 2007/0129165 | A1 | 6/2007 | Matsunaga et al. | |
| 2009/0131200 | A1 | 5/2009 | Akinori et al. | |
| 2011/0124431 | A1 | 5/2011 | Karube | |

FOREIGN PATENT DOCUMENTS

| | | | |
|---|---|---|---|
| JP | 5-28381 | U | 4/1993 |
| JP | 5-82454 | A | 11/1993 |
| JP | 6-39039 | A | 5/1994 |
| JP | 7-7666 | U | 2/1995 |
| JP | 10-071222 | A | 3/1998 |
| JP | 2001-252377 | A | 9/2001 |

(Continued)

OTHER PUBLICATIONS

Notice of Reasons for Refusal dated Jul. 1, 2014 for corresponding Japanese Patent Application No. 2010-290617.

*Primary Examiner* — Michael Dennis

(74) *Attorney, Agent, or Firm* — Birch, Stewart, Kolasch & Birch, LLP

(57) ABSTRACT

A golf club 2 includes a shaft 6, a grip 8 mounted to an end part of the shaft 6, a cavity body 10 mounted to the end part of the shaft 6 to which the grip 8 is mounted, and a weight body 12 detachably mounted to the cavity body 10. The cavity body 10 includes a polymer. Preferably, an outer peripheral surface 16*a* of the cavity body 10 is mounted to an inner peripheral surface 6*a* of the shaft so as to abut on the inner peripheral surface 6*a*. Two or more projections are formed on one of the outer peripheral surface 16*a* of the cavity body 10 and the inner peripheral surface 6*a* of the shaft. Two or more recessed parts are formed on the other. The two or more projections are engaged with the two or more recessed parts.

7 Claims, 12 Drawing Sheets

(56) References Cited

FOREIGN PATENT DOCUMENTS

| | | | |
|---|---|---|---|
| JP | 2006-223566 | A | 8/2006 |
| JP | 2007-151826 | A | 6/2007 |
| JP | 3142270 | U | 5/2008 |
| JP | 2009-112500 | A | 5/2009 |
| JP | 5028361 | B2 | 6/2012 |

* cited by examiner

GOLF CLUB

The present application claims priority on Patent Application No. 2010-290617 filed in JAPAN on Dec. 27, 2010, the entire contents of which are hereby incorporated by reference.

BACKGROUND OF THE INVENTION

1. Field of the Invention

The present invention relates to a golf club capable of adjusting a club balance.

2. Description of the Related Art

A club balance (swingweight) of a golf club contributes to easiness of swing. Club balances suitable for golf players are different. In order to adjust the club balance, there are provided a golf club having a shaft having one end into which a weight object is inserted, a golf club having a head into which a gel is injected, and a golf club having the shaft having the other end to which the weight object is mounted, or a grip to which the weight object is mounted, or the like.

For example, a golf club having a grip to which a weight is detachably mounted is disclosed in Japanese Patent Application Publication No. 4507266 (US2011/124431). A golf club having a grip end to which a weight is mounted so as to protrude from the grip end is disclosed in Japanese Patent Application Publication No. 3826313 (US2004/38762, US2006/63618) and Japanese Patent Application Laid-Open No. 2001-252377. A golf club having a shaft having one end to which a weight is movably mounted is disclosed in Japanese Utility Model Application Laid-Open No. 06-39039 and Japanese Utility Model Application Laid-Open No. 05-82454.

In these golf clubs, a weight balance of the club can be changed by replacing the weight and by changing the mounting position of the weight. The club balance is adjusted by changing the weight balance. Thereby, the golf club can be adjusted to the club balance suitable for the golf player.

An impact transmitted to hands when a ball is hit by a golf club having a reduced weight is apt to be increased. An impact transmitted to the hands when the ball is hit at an off-center is apt to be further increased. A golf club having a shaft to which a weight is mounted in order to absorb the impact vibration is disclosed in Japanese Patent Application Laid-Open No. 10-71222. A weight covered with an elastic body is detachably mounted to the golf club. The golf club can absorb the impact vibration.

The grip held by the golf player is made of a relatively soft material. The mounting position of the weight object detachably mounted to the grip is hardly stabilized. When the weight object is mounted by a screw, the weight object is can be certainly fixed. However, the attaching/detaching operation requires time and effort. The weight of the weight object is not changed in the golf club in which the mounting position of the weight object is changed to adjust the club balance. Thereby, when a position of the weight object is not greatly changed, it is difficult to sufficiently adjust the club balance. The adjusting operation of the club balance in the golf club also requires time and effort.

The weight saving of the golf club is further advanced, which is apt to increase an impact force received by the hands. Further improvement of vibration absorptivity of the golf club is also demanded.

It is an object of the present invention to provide a golf club having an easily adjusted club balance and having excellent vibration absorptivity.

SUMMARY OF THE INVENTION

A golf club according to the present invention includes a shaft, a grip mounted to an end part of the shaft, a cavity body mounted to the end part of the shaft to which the grip is mounted, and a weight body detachably mounted to the cavity body. The cavity body is made of a polymer.

Preferably, an outer peripheral surface of the cavity body is mounted to an inner peripheral surface of the shaft so as to abut on the inner peripheral surface. Two or more projections are formed on one of the outer peripheral surface of the cavity body and the inner peripheral surface of the shaft. Two or more recessed parts are formed on the other. The two or more projections are engaged with the two or more recessed parts.

Preferably, a complex elastic modulus (a measured value under conditions of a temperature of 5° C. and a frequency of 10 Hz) of the polymer of the cavity body is $1.0\times10^{8}$ dyn/cm$^2$ or greater and $1.0\times10^{10}$ dyn/cm$^2$ or less.

Preferably, the weight body includes a headpart, an engaging part, and a neck part located between the head part and the engaging part. The engaging part has a noncircular sectional shape. The cavity body includes an internal space, an inner surface surrounding the internal space, and a through hole extending through the internal space from an upper surface of the cavity body. The through hole has a noncircular shape.

An attitude of the weight body can be changed between a disengaged attitude and an engaged attitude by rotating the weight body to the cavity body by a predetermined angle θ with an axis line of the through hole as a rotation axis in an inserted state where the engaging part and the neck part are inserted into the cavity body from the through hole.

The head part of the weight body abuts on the upper surface of the cavity body in the inserted state. The neck part is located in the through hole. The engaging part is located in the internal space. The engaging part and the neck part can be drawn out from the through hole in the disengaged attitude. The engaging part is engaged with an edge of the through hole in the engaged attitude, so that the engaging part and the neck part cannot be drawn out from the through hole.

The inner surface surrounding the internal space of the cavity body includes a resistance surface and an abutting surface. The abutting surface abuts on the engaging part in the engaged attitude. When the attitude is changed to the engaged attitude from the disengaged attitude, the resistance surface slides with the engaging part, to apply a rotation resistance. The engaging part is positioned in a rotating direction by the abutting surface and the resistance surface in the engaged attitude.

Preferably, the angle θ is equal to or less than 90 degrees.

Preferably, the cavity body includes an insertion part inserted into the shaft and a collar part abutting on an end face of the shaft. A plurality of cavity bodies is provided, which have collar parts having different lengths in an axial direction of the shaft. One of the plurality of cavity bodies is mounted, to enable adjustment of a length of the golf club.

Preferably, the cavity body includes two or more polymers. The polymers have different complex elastic modulus.

Since the weight body is mounted to the shaft via the cavity body including the polymer in the golf club according to the present invention, the weight body is easily mounted/dismounted, to easily adjust a club balance. The golf club has excellent vibration absorptivity.

DESCRIPTION OF THE PREFERRED EMBODIMENTS

Hereinafter, the present invention will be described in detail based on preferred embodiments with appropriate references to the drawings.

Figure 1:
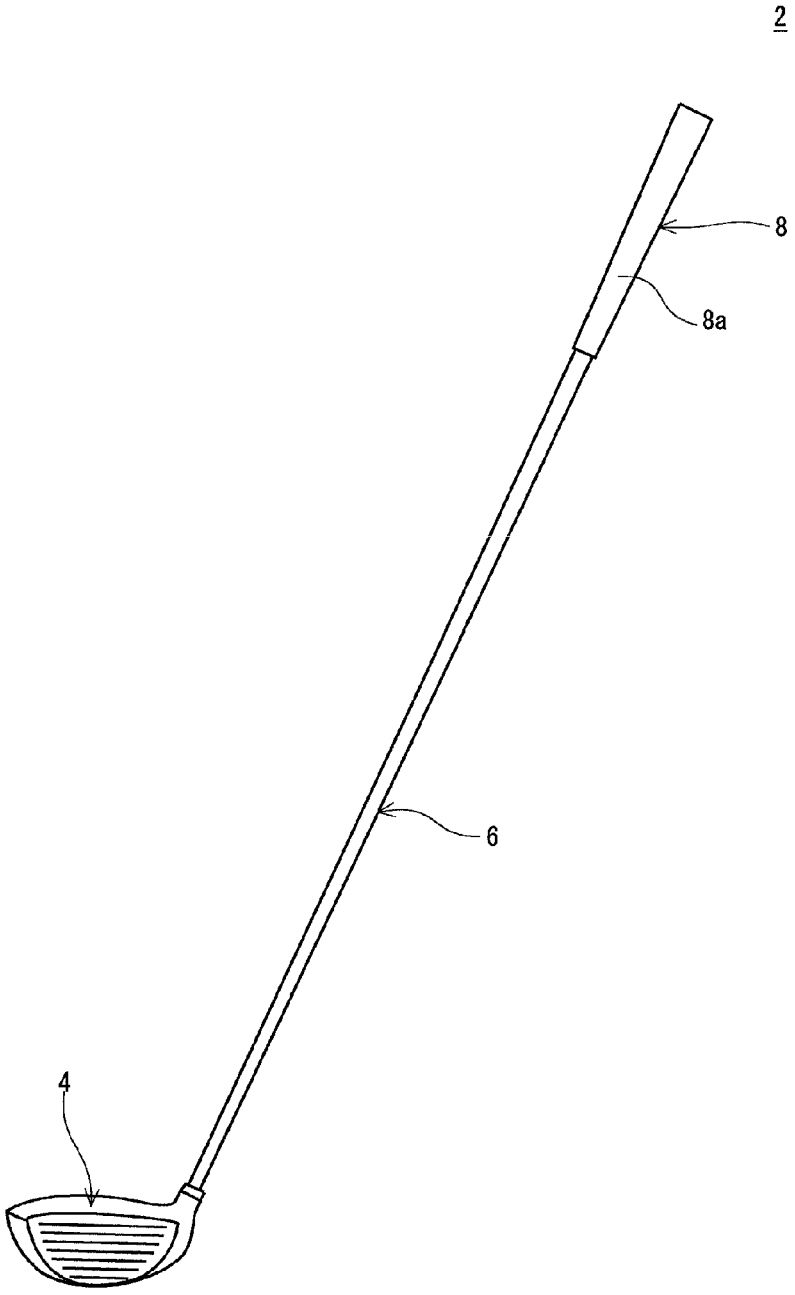
FIG. 1 is a front view showing a golf club according to one embodiment of the present invention.

A golf club 2 of FIG. 1 is provided with a head 4, a shaft 6, and a grip 8. The head 4 is mounted to one end part of the shaft 6. The grip 8 is mounted to the other end part of the shaft 6. In the following description, an "axial direction" means a direction of a central axis line of the shaft 6 unless particularly described.

The head 4 is a wood type head. The head 4 is exemplary. An iron type head and a putter type head may be used in place of the head 4. The shaft 6 has a long cylindrical shape. Examples of the shaft 6 include a steel shaft and a so-called carbon shaft.

The grip 8 has an approximately cylindrical shape. Although not shown in the drawings, grooves are formed in a holding surface 8*a* which is an outer peripheral surface of the grip 8. When a golf player swings the golf club 2, the golf player holds the holding surface 8*a*.

Although a material of the grip 8 is not particularly restricted, the material is preferably a rubber. For example, a natural rubber, a styrene-butadiene rubber, EPDM, an isoprene rubber, and a mixture thereof are preferable. In respect of moldability of the grip 8, the EPDM and the styrene-butadiene rubber are more preferable.

Figure 2:
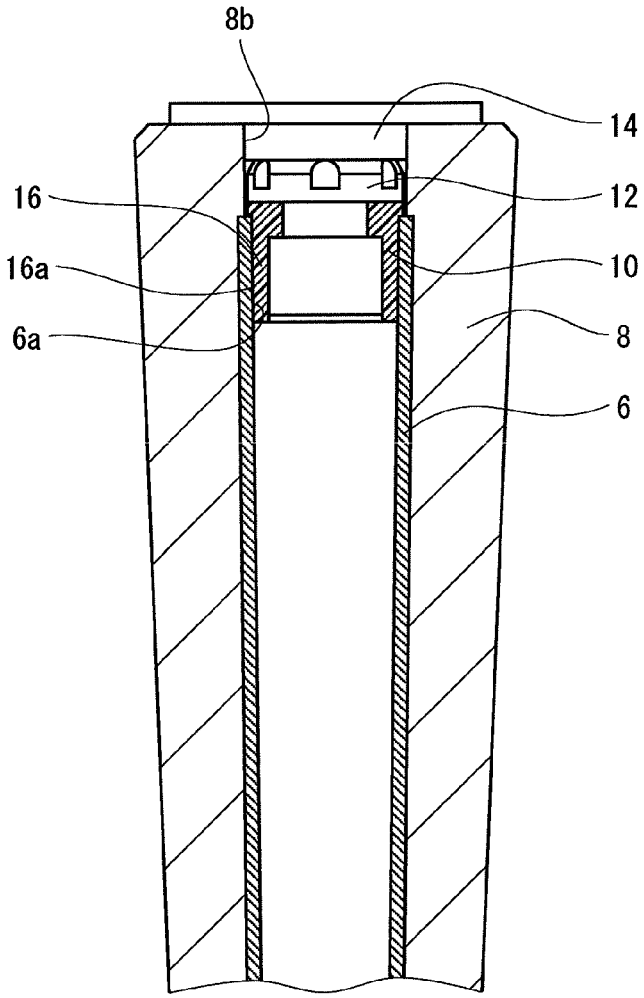
FIG. 2 is an illustration showing a section of a vicinity of a grip end of the golf club of FIG. 1.

As shown in FIG. 2, the golf club 2 is provided with a cavity body 10, a weight body 12, and a cap 14. The cavity body 10, which is inserted into an inner peripheral surface 6*a* from the other end of the shaft 6, is detachably mounted to the shaft 6. The weight body 12 is detachably mounted to the cavity body 10. The grip 8 is mounted to the other end part of the shaft 6. The grip 8 covers the other end part of the shaft 6, the cavity body 10, and the weight body 12. The cap 14 blocks an opening 8*b* of the grip 8.

Figure 3:
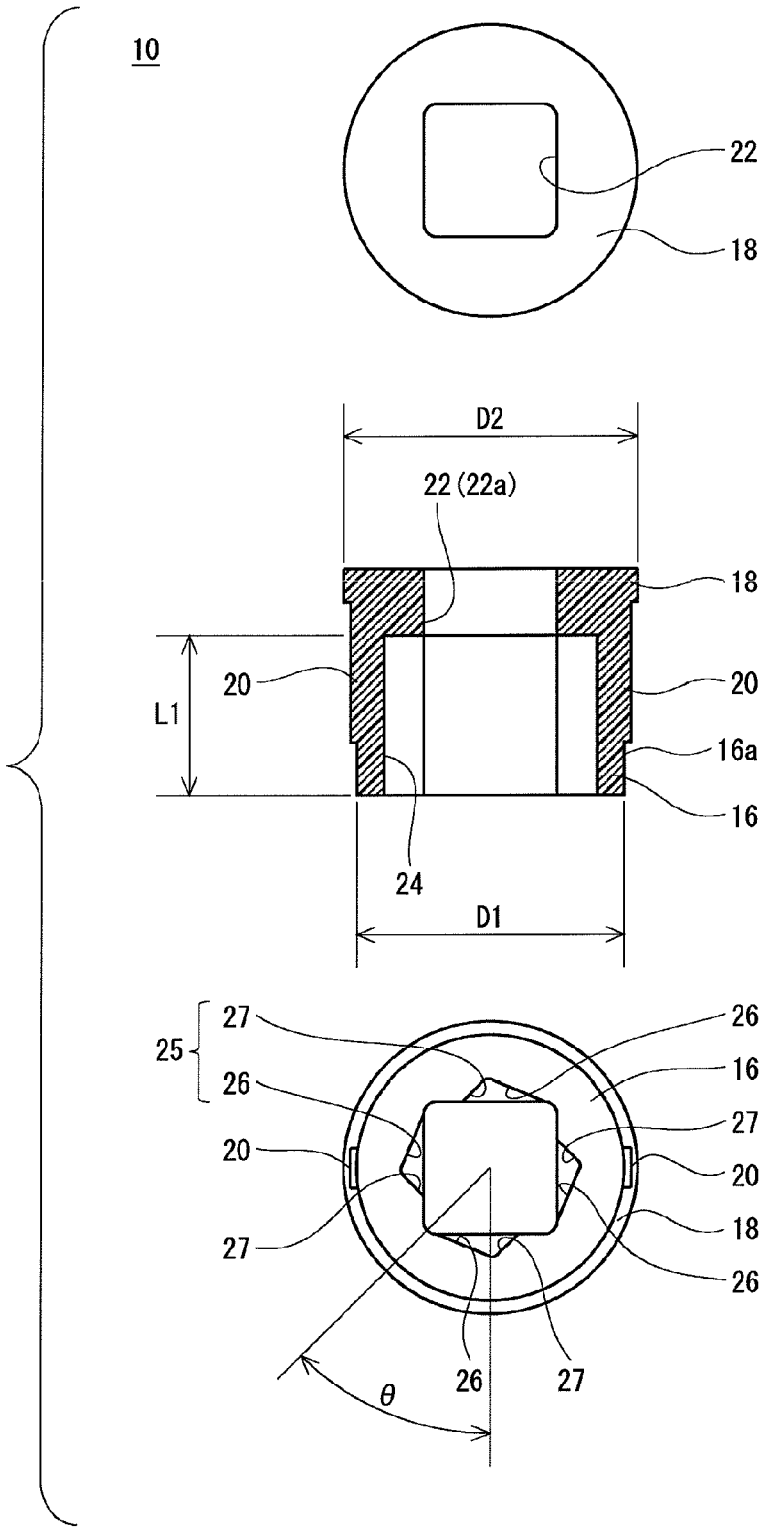
FIG. 3 is an illustration of a cavity body shown in FIG. 2.

As shown in FIG. 3, the cavity body 10 has an insertion part 16, a collar part 18, and projections 20. An outer shape of the insertion part 16 is a cylindrical shape. An outer shape of the collar part 18 is also a cylindrical shape. An outer diameter D1 of the insertion part 16 is smaller than an outer diameter D2 of the collar part 18. The insertion part 16 is integrated with the collar part 18 in a state where an upper end of the insertion part 16 is overlapped with a lower end of the collar part 18 with axis lines thereof coinciding with each other. The projections 20 are provided on an outer peripheral surface 16*a* of the insertion part 16. The projections 20 extend toward a lower end side of the insertion part 16 in parallel with the axis line of the insertion part 16 from the collar part 18. Herein, two projections 20 are formed at equal intervals in a peripheral direction of the insertion part 16.

A through hole 22 and a hole 24 as an internal space are formed in the cavity body 10. The through hole 22 extends through the hole 24 from the upper part of the cavity. For example, a section of the through hole 22 has an approximately square shape. Herein, the approximately square shape is exemplified as the section of the through hole 22. However, the section of the through hole 22 may be a section having a noncircular shape such as a rectangle, a pentagon, or an ellipse shape.

The hole 24 is formed to reach a predetermined depth L1 from a lower end face of the cavity body 10. The hole 24 is surrounded by an inner surface 25. The inner surface 25 has a resistance surface 26 and an abutting surface 27.

The cavity body 10 is made of a polymer. The polymer is hard. The polymer can be elastically deformed. The polymer is preferably a resin or a rubber. Herein, the description will be made using the resin as an example. In respect of processability, a thermoplastic resin and a fiber-reinforced resin thereof are preferable as the resin. Examples thereof include polyurethane, a polyether block copolymer, and polycarbonate.

Figure 4:
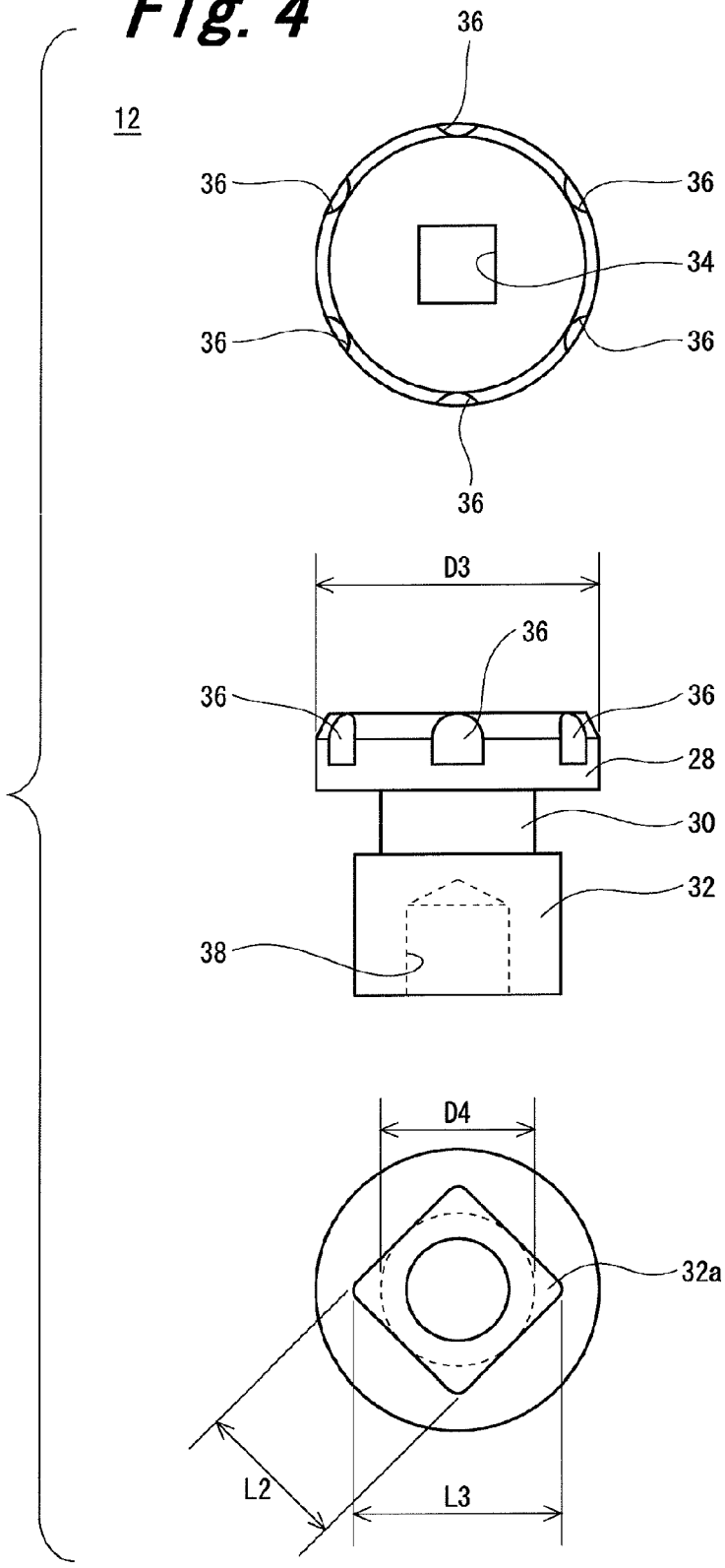
FIG. 4 is an illustration of a weight body shown in FIG. 2.

As shown in FIG. 4, the weight body 12 includes a head part 28, a neck part 30, and an engaging part 32. The head part 28 and the neck part 30 have an approximately cylindrical shape. A quadrangle hole 34 is formed at a center of an upper end face of the head part 28. A plurality of cutouts 36 is formed in an outer peripheral surface of the head part 28. An outer diameter D3 of the head part 28 is greater than an outer diameter D4 of the neck part.

The engaging part 32 has a noncircular section. For example, the section has an approximately square shape. The engaging part 32 can pass through the through hole 22. Herein, the engaging part 32 is a quadranglar prism. A double-pointed arrow L2 shows a length of one side of the approximately square shaped section of the engaging part 32. A double-pointed arrow L3 shows a length of a diagonal line of the approximately square shaped section. The length L2 is made the same as the outer diameter D4 of the neck part 30. A length L3 is made greater than the outer diameter D4 of the neck part 30. The engaging part 32 has a bottomed hole 38 formed from a lower end face thereof.

The engaging part 32 has a corner part 32*a* as a protruding part. The corner part 32*a* protrudes to a radial direction of the weight body 12. A protruding amount (a protruding amount from a center of the engaging part 32 in the radial direction) of the corner part 32*a* of the engaging part 32 is set to ½ of the length L3.

A material having a specific gravity greater than that of the cavity body 10 is used for the weight body 12. In respect of durability and the specific gravity, examples of the material of the weight body 12 include a metal such as an aluminum alloy, a titanium alloy, or a tungsten alloy.

Figure 5:
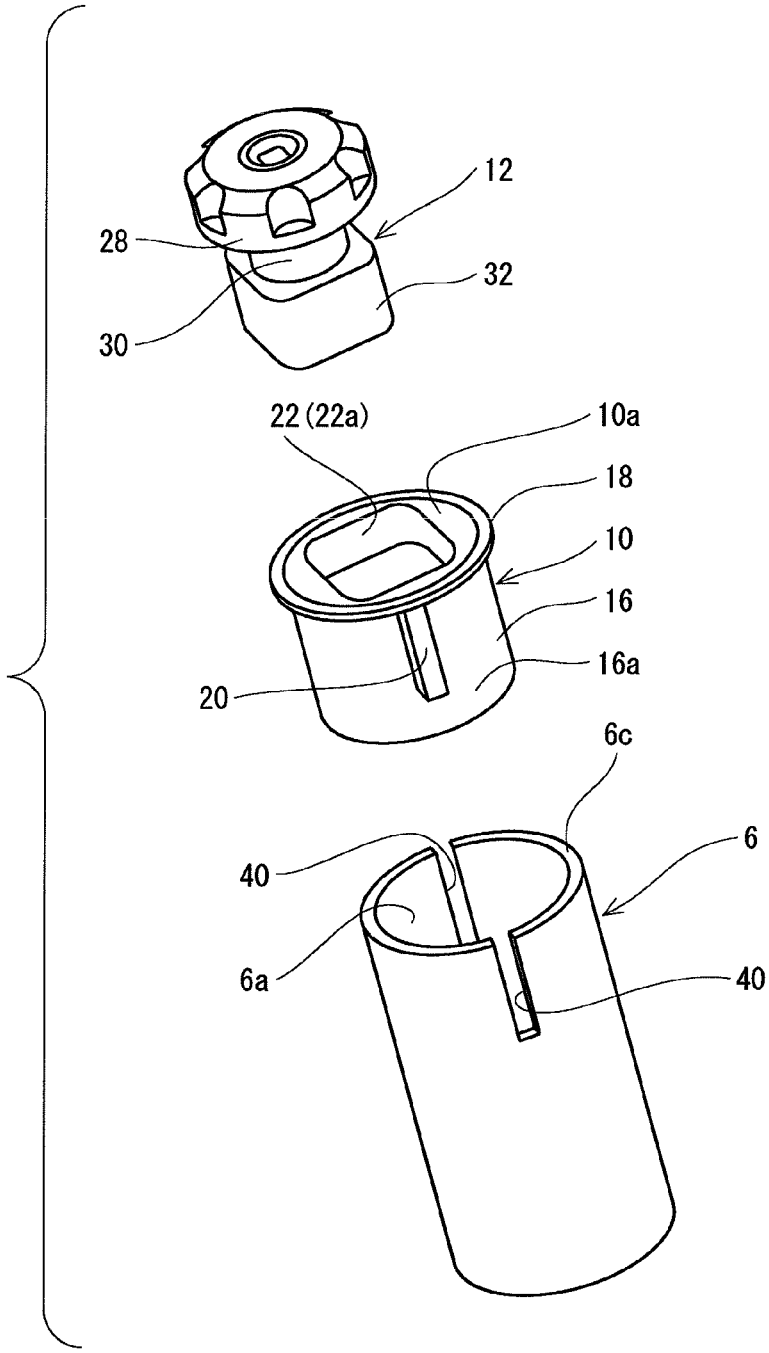
FIG. 5 is an illustration showing the end part of a shaft shown in FIG. 2, a cavity body, and a weight body.

As shown in FIG. 5, cutouts 40 as recessed parts are formed in an end part of the shaft 6. The cutouts 40 are formed at equal intervals in a peripheral direction of the shaft 6. The insertion part 16 of the cavity body 10 is inserted from the other end of the shaft 6. The outer peripheral surface 16*a* of the insertion part 16 of the cavity body 10 is mounted to the inner peripheral surface 6*a* of the shaft 6 so as to be brought into contact with the inner peripheral surface 6*a*. The projections 20 are engaged with the cutouts 40. Thereby, the cavity body 10 is rotation-prevented with respect to the shaft 6. The collar part 18 abuts on an end face 6*c* of the shaft 6. The cavity body 10 is detachably mounted to the other end of the shaft 6.

The engaging part 32 of the weight body 12 is penetrated through the through hole 22 of the cavity body 10. The neck part 30 and engaging part 32 of the weight body 12 are inserted into the cavity body 10, so that the weight body 12 is brought into in an inserted state. In the inserted state, the head part 28 of the weight body 12 abuts on an upper surface 10*a* of the cavity body 10. The neck part 30 is located in the through hole 22. The engaging part 32 is located in the hole 24.

In a state where the neck part 30 and the engaging part 32 are merely inserted, the neck part 30 and the engaging part 32 are drawably inserted from the through hole 22. An attitude in which the weight body 12 is drawably inserted is a disengaged attitude. When the weight body 12 is rotated with respect to the cavity body 10 in the inserted state with an axis line of the through hole 22 as a rotation axis, the engaging part 32 is engaged with an edge 22*a* of the through hole 22. A part of the edge 22*a* enters between the head part 28 and the engaging part 32. The neck part 30 and the engaging part 32 take such an attitude that the neck part 30 and the engaging part 32 cannot be drawn from the through hole 22. The attitude in which the weight body 12 cannot be drawn from the cavity body 10 is an engaged attitude. In the engaged attitude, the weight body 12 is mounted to the cavity body 10 so as to be engaged with the cavity body 10.

An angle θ of FIG. 3 shows a dimension of a rotation angle when the weight body 12 of the disengaged attitude takes the engaged attitude. A shape of the hole 24 of the cavity body 10 approximates a space shape formed when the engaging part 32 of the weight body 12 is rotated by a predetermined angle θ from the disengaged attitude, so that the attitude of the engaging part 32 is changed to the engaged attitude. The resistance surface 26 of the hole 24 is formed to protrude toward the inside in the radial direction with respect to the space shape.

Figure 6:
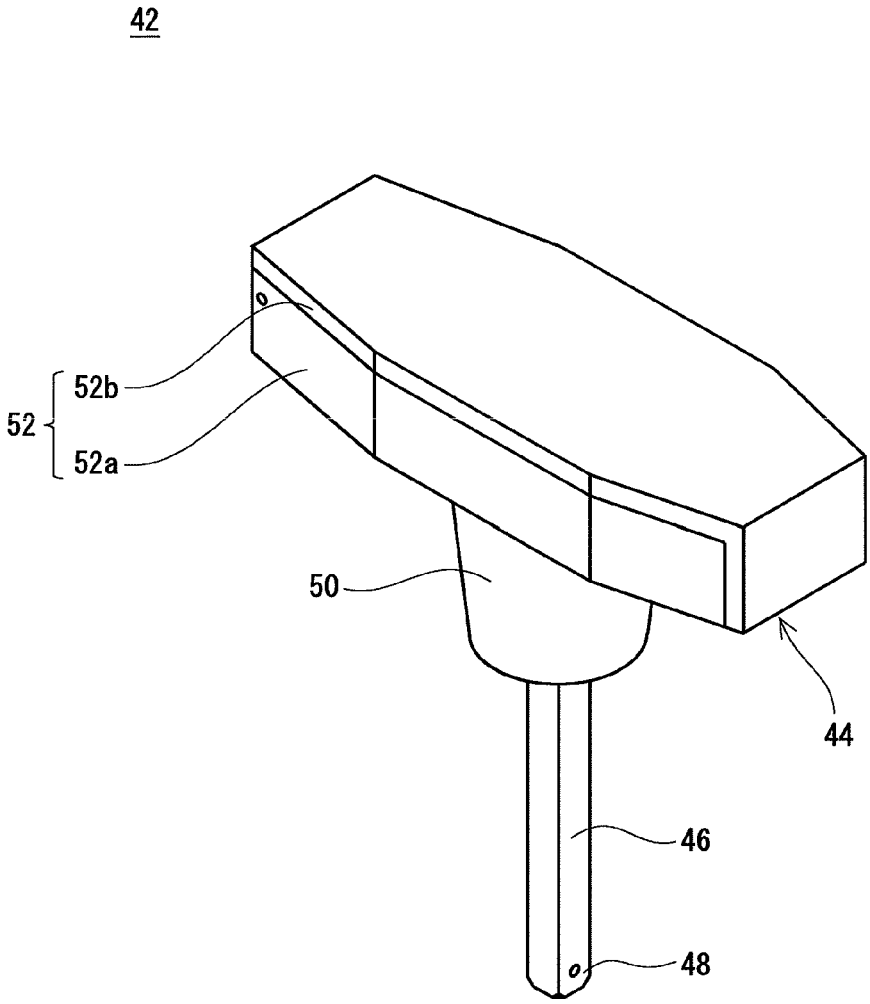
FIG. 6 is an illustration of a tool used for attaching/detaching the weight body shown in FIG. 2.

A screwdriver 42 of FIG. 6 is used for attaching/detaching the weight body 12. The screwdriver 42 has a handle 44, a shaft 46, and a blade edge 48. The handle 44 is formed by a handle body 50 and a holding part 52 extending in a direction vertically crossing with a rotation axis of the screwdriver 42 from the upper part of the handle body 50. The holding part 52 is provided with a holding body part 52*a* and a lid 52*b*.

Figure 7:
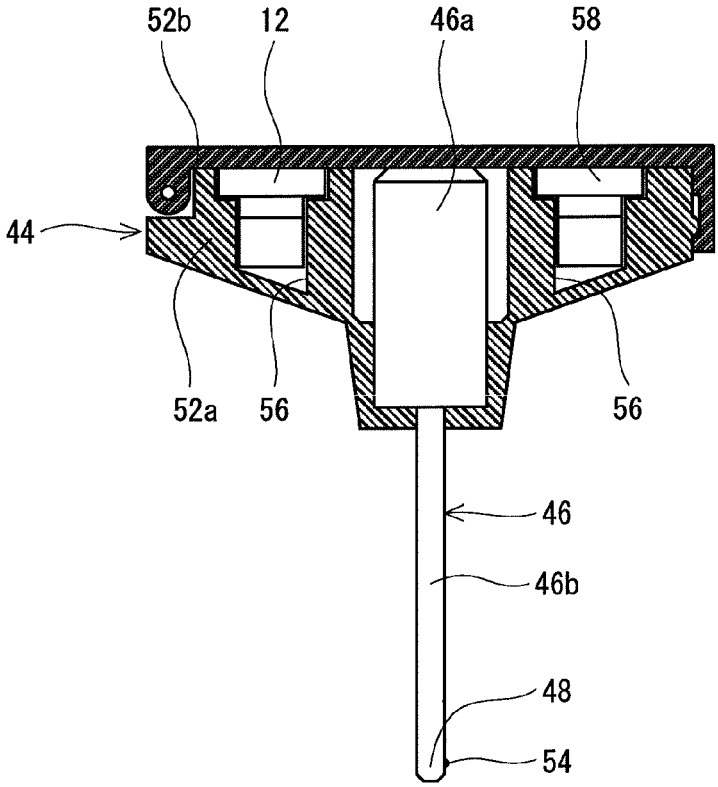
FIG. 7 is an illustration showing a section of the tool of FIG. 6.

As shown in FIG. 7, a back end part 46*a* of the shaft 46 is rotation-prevented to the holding body part 52*a*, and thereby the shaft 46 is fixed to the holding body part 52*a*. A tip part 46*b* of the shaft 46 protrudes from the handle 44. The blade edge 48 is located at a tip of the tip part 46*b*. The blade edge 48 has a quadrangle section. An engaging pin 54 protrudes from a side surface of the blade edge 48. The engaging pin 54 is built in the blade edge 48. Although not shown in the drawings, a coil spring as an elastic body is built in the blade edge 48. The engaging pin 54 is energized in a direction protruding from the blade edge 48 by an energizing force of the coil spring.

A pair of pockets 56 is formed in the holding body part 52*a*. The holding body part 52*a* is closed by the lid 52*b*. The weight body 12 is housed in one pocket 56, and a weight body 58 is housed in the other pocket 56. The weight body 12 or 58 can be taken out by opening the lid 52*b*.

Although not shown in the drawings, dimensions and shapes of the cutout 36 and bottomed hole 38 of the weight body 12 are different from those of the weight body 58. Thereby, even when a material of the weight body 12 is the same as that of the weight body 58, a mass of the weight body 12 is different from that of the weight body 58. Materials having different specific gravities may be used for the weight bodies 12 and 58 while a shape of the weight body 12 is made the same as that of the weight body 58.

The number of the pockets 56 is not restricted to 2. The number may be 1, or equal to or greater than 3. The number of the weight bodies to be housed may be 1, or equal to or greater than 3. A section of the blade edge 48 corresponds to the quadrangle hole 34 of the weight body 12. The section of the blade edge 48 may correspond to the sectional shape of the hole of the weight body 12 with which the blade edge 48 is engaged. The sectional shape of the blade edge 48 is not restricted to the above-mentioned quadrangle.

Figure 8A:
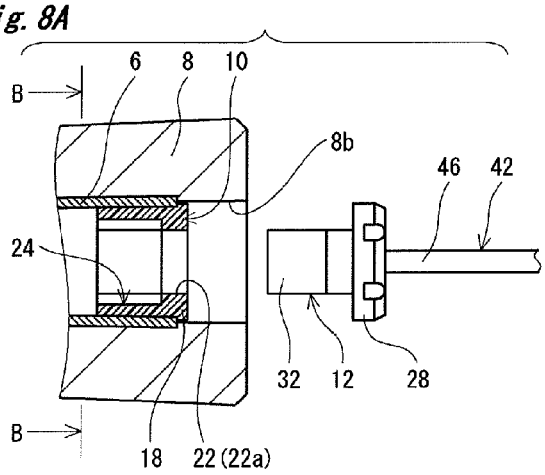
FIGS. 8A to 8F are illustrations showing a use condition of the golf club of FIG. 1.
Figure 8B:
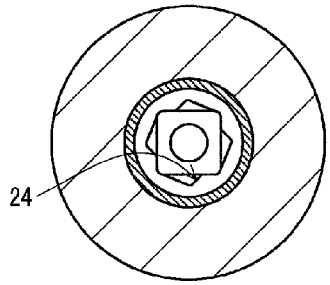

A section of the shaft 6 and vicinity of a grip end of the grip 8, and a section of the cavity body 10 are shown in FIG. 8A. The weight body 12 and the shaft 46 of the screwdriver 42 are shown with the sections. In FIG. 8B, a B-B section of FIG. 8A is shown.

Figure 8C:
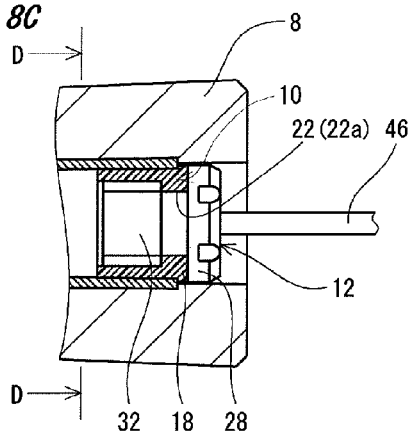
Figure 8D:
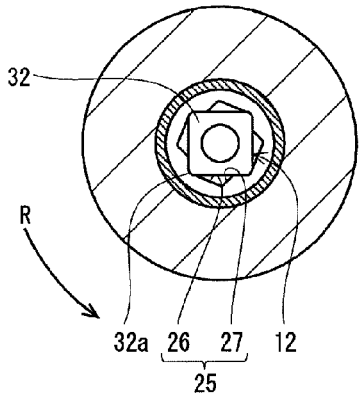
Figure 8E:
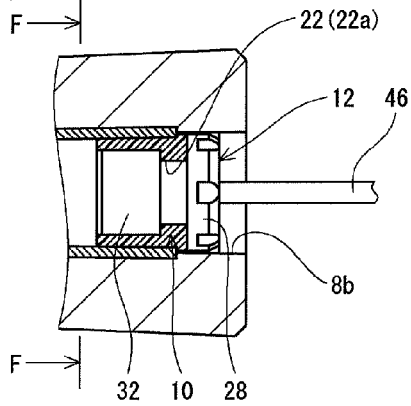
Figure 8F:
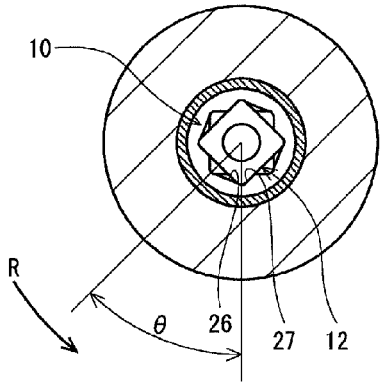

The weight body 12 and the cavity body 10 which are in the disengaged attitude are shown in FIG. 8C. In FIG. 8D, a D-D section of FIG. 8C is shown. The weight body 12 and the cavity body 10 which are in the engaged attitude are shown in FIG. 8E. In FIG. 8F, an F-F section of FIG. 8E is shown. An arrow R of FIG. 8F shows a rotation direction of the weight body 12 and shaft 46. In the golf club 2, an angle θ is set to 45 degrees.

A method for attaching the weight body 12 will be described with reference to FIGS. 8A to 8F. In FIG. 8A, a state where the cap 14 is removed is shown. Although not shown in the drawings, the blade edge 48 of the screwdriver 42 is inserted into the quadrangle hole 34 of the weight body 12. The engaging pin 54 is pressed against the quadrangle hole 34, so that the quadrangle hole 34 and the blade edge 48 are engaged with each other. Thereby, the weight body 12 is supported by the screwdriver 42.

The weight body 12 is inserted into the opening 8*b* of the grip 8 from the grip end in a state where the weight body 12 is engaged with the blade edge 48. The engaging part 32 of the weight body 12 is penetrated through the through hole 22 of the cavity body 10. The head part 28 abuts on the collar part 18. Thus, the cavity body 10 and the weight body 12 are brought into in a state of the disengaged attitude shown in FIGS. 8C and 8D.

In the state of the disengaged attitude, the screwdriver 42 is rotated clockwise. An arrow R of FIG. 8D shows a rotation direction when the screwdriver 42 is rotated clockwise as in FIG. 8F. Although not shown in the drawings, the cutouts 40 of the shaft 6 are engaged with the projections 20 of the cavity body 10. The weight body 12 is rotated to the direction of the arrow R with respect to the cavity body 10 by rotating the screwdriver 42. Since the two cutouts 40 are engaged with the two projections 20 at this time, the cavity body 10 is certainly supported by the shaft 6. The number of the cutouts 40 may be equal to or greater than 3, and the number of the projections 20 may be equal to or greater than 3.

While the corner part 32*a* of the engaging part 32 slides on the resistance surface 26, the weight body 12 is rotated with respect to the cavity body 10. The resistance surface 26 applies a rotation resistance to rotation of the engaging part 32. The cavity body 10 is elastically deformed by the sliding.

When the weight body 12 is rotated by the angle θ, the corner part 32*a* abuts on the abutting surface 27 of the hole 24. The corner part 32*a* is positioned in the rotating direction by the resistance surface 26 and the abutting surface 27. The corner part 32*a* of the engaging part 32 is engaged with the through hole 22 of the cavity body 10. The weight body 12 is positioned in the rotating direction and the axial direction with respect to the cavity body 10. Thus, the cavity body 10 and the weight body 12 are brought into in a state of the engaged attitude shown in FIGS. 8E and 8F.

As shown in FIGS. 8E and 8F, the weight body 12 is mounted to the cavity body 10 so as to be positioned and fixed to the cavity body 10. Although not shown in the drawings, the screwdriver 42 is drawn out in a direction away from the shaft 6. The blade edge 48 is drawn out from the quadrangle hole 34 of the weight body 12. The opening 8*b* of the grip 8 is closed by the cap 14. The cap 14 may be absent.

A method for changing the weight body 12 to the other weight body 58 will be described. The cap 14 is removed. The blade edge 48 of the screwdriver 42 is inserted into the quadrangle hole 34 of the weight body 12. The weight body 12 is in the engaged attitude of FIGS. 8E and 8F. The screwdriver 42 is rotated counterclockwise (in a direction reverse to the arrow R of FIG. 8F). The weight body 12 is rotated counterclockwise to the cavity body 10. While the corner part 32*a* of the engaging part 32 slides on the resistance surface 26, the weight body 12 is rotated with respect to the cavity body 10. The cavity body 10 is elastically deformed by the sliding. When the weight body 12 is rotated counterclockwise by the angle θ (see FIG. 8F), the engaged attitude is changed to the disengaged attitude. The cavity body 10 and the weight body 12 are brought into the state of FIGS. 8C and 8D.

The screwdriver 42 is drawn out in the direction away from the shaft 6. Since the quadrangle hole 34 and the blade edge 48 are engaged with each other, the weight body 12 is drawn out in the direction away from the shaft 6. The engaging part 32 passes through the through hole 22, so that the weight body 12 is drawn out from the cavity body 10. Thus, the cavity body 10 and the weight body 12 is brought into the state of FIGS. 8A and 8B.

The weight body 12 is removed from the blade edge 48 of the screwdriver 42. The lid 52*b* of the screwdriver 42 is opened, and the weight body 12 is then housed in the vacant pocket 56 (see FIG. 7). The weight body 58 housed in the other pocket 56 is taken out. The weight body 58 is mounted to the blade edge 48 of the screwdriver 42. The weight body 58 is attached to the cavity body 10 in the same manner as in the above-mentioned method for attaching the weight body 12. Since the mass of the weight body 12 is different from that of the weight body 58, a club balance of the golf club 2 is changed.

In the golf club 2, the weight body 12 is fixed to the cavity body 10 by rotating the weight body 12 by the angle θ. The fixation is released by reversely rotating the weight body 12 by the angle θ. In the golf club 2, the weight body 12 is easily attached/detached. In respect of easily attaching/detaching the weight body, the angle θ is preferably equal to or less than 90 degrees, and more preferably equal to or less than 45 degrees.

The attaching structure is exemplary, and the present invention is not restricted to the attaching method. For example, the attaching structure may be a so-called BNC connector type attaching structure. In respect of detachably fixing the weight body 12 to the cavity body 10 certainly, the weight body 12 may be merely screwed into the cavity body 10 so as to be fixed to the cavity body 10.

As shown in FIG. 2, the golf club 2 to which the weight body 12 is attached is prepared. A golf player holds the grip 8, and swings the golf club 2. The golf player hits a ball which is not shown. When the golf player hits the ball, hitting vibration is transmitted to the golf player's hands via the golf club 2.

Vibration energy of the hitting vibration is converted into kinetic energy of the weight body 12 housed in the cavity body 10 made of an elastic body. The cavity body 10 and the weight body 12 convert the vibration energy of the shaft 6 into the kinetic energy of the weight body 12 to alleviate the hitting vibration.

In respect of certainly fixing the weight body 12 to the cavity body 10, a complex elastic modulus of a resin of the cavity body 10 is preferably equal to or greater than $1.0\times10^8$ dyn/cm$^2$, and more preferably equal to or greater than $5.0\times10^8$ dyn/cm$^2$. In respect of vibration absorptivity, the complex elastic modulus is preferably equal to or less than $1.0\times10^{10}$ dyn/cm$^2$, and more preferably equal to or less than $5.0\times10^9$ dyn/cm$^2$.

Examples of the material having a complex elastic modulus include "Himilan 1605" (trade name) manufactured by DUPONT-MITSUI POLYCHEMICALS CO., LTD, "Pebax 5533" (trade name) manufactured by ARKEMA, and "RILSAN-BMNO" (11-Nylon) (trade name) manufactured by ARKEMA.

The complex elastic modulus can be measured using a viscoelastic measuring apparatus (viscoelastic spectrometer DVA200 advanced model manufactured by SHIMADZU CORPORATION). The measurement conditions are as follows.

a dimension of a specimen: a width of 4.0 mm, a thickness of 2.0 mm, and a length of 30.0 mm a length dimension in a displaced portion: 20.0 mm (lengths of 5.0 mm from both ends in the length of 30.0 mm are held)

a frequency: 10 Hz a temperature rising speed: 2° C./min an initial strain: 2 mm a displacing amplitude width: ±12.5 μm a measurement temperature: 5° C.

Figure 9A:
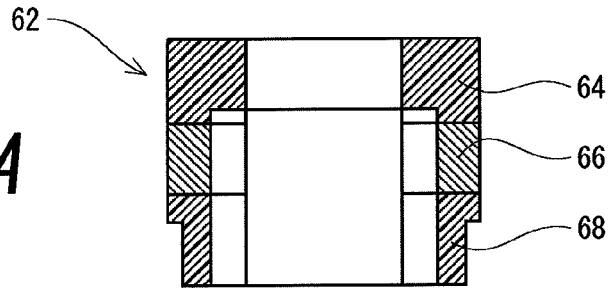
FIGS. 9A and 9B are illustrations showing a section of a cavity body of a golf club according to another embodiment of the present invention.

A cavity body 62 of a golf club according to another embodiment of the present invention is shown in FIG. 9A. A shape of the cavity body 62 is the same as that of the cavity body 10. The cavity body 62 includes an upper part 64 located on an upper side thereof, a middle part 66 located under the upper part 64, and a lower part 68 located under the middle part 66. A polymer of the middle part 66 is different from those of the upper part 64 and lower part 68. A complex elastic modulus of the polymer of the middle part 66 is made smaller than those of the upper part 64 and lower part 68.

In the cavity body 62, two different polymers are brought into contact with the shaft 6. The two different polymers are brought into contact with the weight body 12. Vibration energies having different frequencies can be absorbed by combining the two polymers.

Since the complex elastic modulus of the polymers of the upper part 64 and the lower part 68 are increased, the weight body 12 can be certainly fixed. The cavity body 62 can be certainly fixed to the shaft 6. Preferably, the complex elastic modulus of the upper part 64 and lower part 68 are preferably equal to or greater than $1.0\times10^8$ dyn/cm$^2$, and more preferably equal to or greater than $5.0\times10^8$ dyn/cm$^2$. The complex elastic modulus of the upper part 64 and lower part 68 are preferably equal to or less than $1.0\times10^{10}$ dyn/cm$^2$, and more preferably equal to or less than $5.0\times10^9$ dyn/cm$^2$. The complex elastic modulus of the middle part 66 is more preferably equal to or less than $5.0\times10^9$ dyn/cm$^2$, more preferably equal to or less than $1.0\times10^9$ dyn/cm$^2$, and particularly preferably equal to or less than $5.0\times10^8$ dyn/cm$^2$.

The upper part 64, middle part 66, and lower part 68 of the cavity body 62 may be made of polymers having different complex elastic modulus. Furthermore, the upper part 64, the middle part 66, and the lower part 68 may be made of four or more polymers.

Figure 9B:
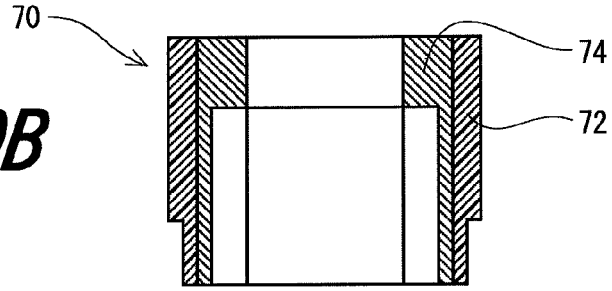

A cavity body 70 of a golf club according to still another embodiment of the present invention is shown in FIG. 9B. A shape of the cavity body 70 is the same as that of the cavity body 10. The cavity body 70 includes an outer peripheral part 72 located on an outer peripheral side thereof, and an inner peripheral part 74 located on an inner peripheral side thereof. A polymer of the outer peripheral part 72 is different from that of the inner peripheral part 74. A complex elastic modulus of the polymer of the outer peripheral part 72 is made greater than that of the inner peripheral part 74.

In the cavity body 70, the complex elastic modulus of the polymer of the outer peripheral part 72 may be made smaller than that of the polymer of the inner peripheral part 74. Since the cavity body 70 is made of two polymers, vibration energies having different frequencies tend to be absorbed. Preferably, the complex elastic modulus of the outer peripheral part 72 and inner peripheral part 74 are preferably equal to or greater than $1.0\times10^9$ dyn/cm$^2$, and more preferably equal to or greater than $5.0\times10^8$ dyn/cm$^2$. The complex elastic modulus of the outer peripheral part 72 and inner peripheral part 74 are preferably equal to or less than $1.0\times10^{10}$ dyn/cm$^2$, and more preferably equal to or less than $5.0\times10^9$ dyn/cm$^2$.

Figure 10:
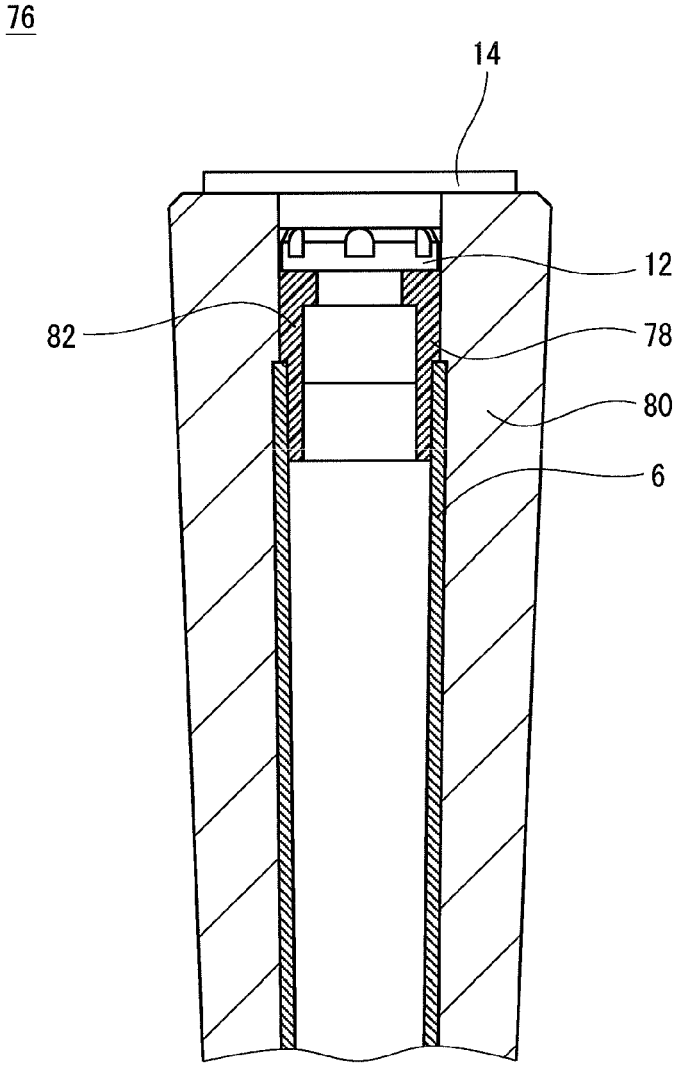
FIG. 10 is an illustration showing a partial section of a golf club according to still another embodiment of the present invention.

A section of a vicinity of a grip end of a golf club 76 according to yet still another embodiment of the present invention is shown in FIG. 10. Although a cavity body 78 and grip 80 of the golf club 76 are different from those of the golf club 2, the other constitutions of the golf club 76 are the same as those of the golf club 2.

A collar part 82 of the cavity body 78 is made longer than the collar part 18 of the cavity body 10 in an axial direction. Thereby, the golf club 76 has a changed club balance and length. The grip 80 is used in place of the grip 8 with the change of the length.

The golf club 76 has the plurality of cavity bodies having different lengths in the axial direction, and thereby the length thereof can be adjusted. The position of the weight body 12 can be also greatly changed. In the golf club 76, the weight body and the mounting position of the weight body can be easily changed. The club balance of the golf club 76 can be easily adjusted in a wide range. Furthermore, for example, even if the different cavity bodies are used, a common grip can be also used. When the common grip is used, an outer peripheral surface of the collar part 82 of the cavity body 78 is preferably located on the extension of the outer peripheral surface of the shaft 6.

Hereinafter, the effects of the present invention will be clarified by examples. However, the present invention should not be interpreted in a limited way based on the description of examples.

EXAMPLES

Comparative Example 1

"SRIXON ZR-700 Driver" (trade name) manufactured by SRI Sports Limited was used as it was. A mass of a grip was 50 g.

Examples 1 to 5 and Comparative Example 2

A remodeled club of "SRIXON ZR-700 Driver" (trade name) in which a vicinity of a grip end was remodeled was prepared as shown in FIG. 2 except that a cap was not mounted. A mass of a grip of the remodeled club was set to 44 g. Cavity bodies and weight bodies shown in Table 1 were attached to the remodeled club, to obtain golf clubs of examples 1 to 5 and comparative example 2.

[Evaluation]

Valuation methods are as follows.

[Measurement of Swing Weight]

A swing weight was measured by using "BANCER-14" (trade name) manufactured by DAININ Corporation. The swing weight is a 14-inch type. The measured values are shown in the following Table 1.

[Measurement of Out-of-Plane Primary Vibration Attenuation Rate]

Figure 11:
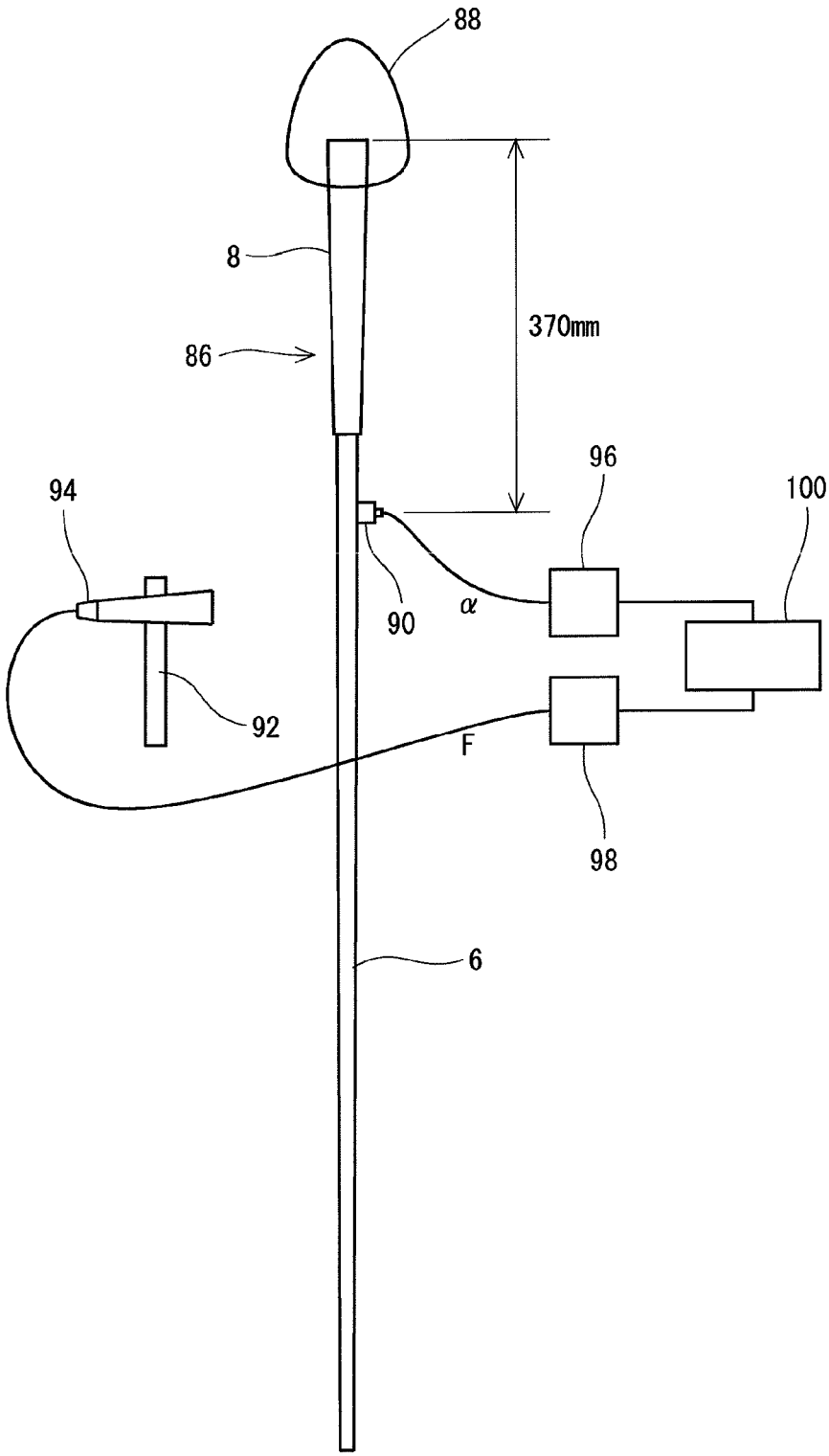
FIG. 11 is an illustration for explaining a method for measuring an out-of-plane primary attenuation rate.

FIG. 11 shows a situation where an out-of-plane primary vibration attenuation rate is measured. In the measurement, a shaft 86 with a grip in which a grip 8 is attached to a shaft 6 is used. A string 88 is mounted to a grip side edge part of the shaft 86 with the grip. An acceleration pickup meter 90 is mounted to a spot of 370 mm from a grip end. The shaft 86 with the grip is hung by using the string 88. In a state where the shaft 86 with the grip is hung, the opposite side (back side) of the acceleration pickup meter 90 is hammered by an impact hammer 92, to excite the shaft 86 with the grip. Input vibration F is measured by a force pickup meter 94 mounted to the impact hammer 92. Response vibration $\alpha$ is measured by the acceleration pickup meter 90. The response vibration $\alpha$ is input into a frequency analysis device 100 via an amplifier 96. The input vibration F is input into the frequency analysis device 100 via an amplifier 98. A dynamic single analyzer HP3562A manufactured by Hewlett-Packard Company was used as the frequency analysis device 100. A transfer function in a frequency region obtained in analysis was determined, to obtain a vibration number of the shaft 86 with the grip. A vibration attenuation rate ($\zeta$) obtained by the following formula is an out-of-plane primary vibration attenuation rate.

$$\zeta=(1/2)\times(\Delta\omega/\omega n)$$

$$To=Tn\times\sqrt{2}$$

Figure 12:
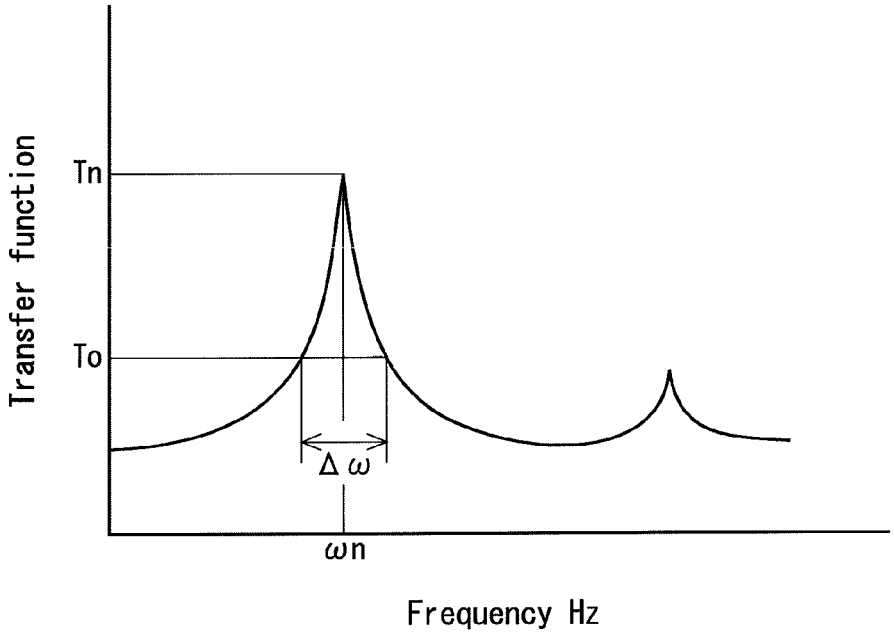
FIG. 12 is an illustration for explaining a method for calculating the out-of-plane primary attenuation rate.

However, as shown in a graph of FIG. 12, $\Delta\omega$ is a frequency of the primary maximum value. Meanings of $\Delta\omega$, Tn and T0 are shown in the graph of FIG. 12.

[Sensuous Evaluations of Easiness of Swing and Vibration Absorptivity]

Each of twenty intermediate- or high-level golf players (satisfying conditions where the golf players have golf experience of more than 10 years and play golf at least once a month at present) hit balls by using the golf clubs of examples and comparative example. Each of the golf players hit five balls using each of the clubs and conducted sensuous evaluation of each of the clubs in terms of easiness of swing and vibration absorptivity at five stages of a scale of one to five. A club thought to have higher vibration absorptivity provides a higher score. The average of the scores is shown in the following Table 1 (Table 1-1 and Table 1-2).

TABLE 1

(Table 1-1)

| | | Comparative Example 1 | Comparative Example 2 | Example 1 | Example 2 |
|---|---|---|---|---|---|
| Cavity body | Material | No | SEPTON 2063 | Himilan 1605 | PEBAX 5533 |
| | Complex elastic modulus [dyn/cm$^2$] | — | $8.39\times10^7$ | $7.09\times10^8$ | $2.72\times10^9$ |

TABLE 1-continued (Table 1-1)

| | Comparative Example 1 | Comparative Example 2 | Example 1 | Example 2 |
|---|---|---|---|---|
| Weight of weight body [g] | 0 | 5 | 5 | 5 |
| Weight of club [g] | 319 | 319 | 319 | 319 |
| Swing weight [14-inch type] | D2 | D2 | D2 | D2 |
| Actual hitting evaluation (easiness of swing) | 3 | 3.2 | 3.1 | 3 |
| Out-of-plane primary attenuation rate [%] | 0.51 | 0.69 | 1.22 | 1.06 |
| Actual hitting evaluation (vibration absorptivity) | 3 | 3.4 | 4.2 | 4 |

TABLE 1

(Table 1-2)

| | | Comparative Example 3 | Example 3 | Example 4 | Example 5 |
|---|---|---|---|---|---|
| Cavity body | Material | 11-NYLON | PEBAX 5533 | PEBAX 5533 | PEBAX 5533 |
| | Complex elastic modulus [dyn/cm$^2$] | $1.45 \times 10^{10}$ | $2.72 \times 10^9$ | $2.72 \times 10^9$ | $2.72 \times 10^9$ |
| Weight of weight body [g] | | 5 | 3 | 7 | 11 |
| Weight of club [g] | | 319 | 317 | 321 | 325 |
| Swing weight [14-inch type] | | D2 | D3 | D1 | C9 |
| Actual hitting evaluation (easiness of swing) | | 3.1 | 2.6 | 3.5 | 3.7 |
| Out-of-plane primary attenuation rate [%] | | 0.60 | 0.95 | 1.11 | 1.20 |
| Actual hitting evaluation (vibration absorptivity) | | 3.2 | 3.8 | 4.1 | 4.2 |

As shown in Table 1, examples are highly evaluated as compared with comparative examples. From the evaluation results, the advantages of the present invention are apparent.

The invention described above can be applied to all golf clubs. The present invention can be used for a wood type golf club, an iron type golf club, and a putter club or the like.

The description hereinabove is merely for an illustrative example, and various modifications can be made in the scope not to depart from the principles of the present invention.

What is claimed is:

1. A golf club comprising:

a shaft having an end part with an end face;

a grip mounted to the end part of the shaft;

a cavity body made of a polymer mounted to the end part of the shaft to which the grip is mounted, wherein the cavity body has a collar part that abuts on the end face of the shaft; and a weight body detachably mounted to the cavity body; and an outer peripheral surface of the cavity body is mounted to an inner peripheral surface of the shaft so as to abut on the inner peripheral surface, wherein: two or more projections are formed on one of the outer peripheral surface of the cavity body and the inner peripheral surface of the shaft; two or more recessed parts are farmed on the other; and the two or more projections are engaged with the two or more recessed parts.

2. The golf club according to claim 1, wherein the polymer of the cavity body has a complex elastic modulus value of $1.0\times10^8$ dyn/cm$^2$ or greater and $1.0\times10^{10}$ dyn/cm$^2$ or less, and wherein the complex elastic modulus is measured under conditions including a temperature of 5° C. and a frequency of 10 Hz.

3. The golf club according to claim 1, wherein the weight body comprises a head part, an engaging part, and a neck part located between the head part and the engaging part, and the engaging part has a noncircular sectional shape;

the cavity body comprises an internal space, an inner surface surrounding the internal space, and a through hole having a noncircular shape extending through the internal space from an upper surface of the cavity body;

the weight body position can be changed between a disengaged position and an engaged position by rotating the weight body to the cavity body by a predetermined angle θ with an axis line of the through hole as a rotation axis in an inserted state where the engaging part and the neck part are inserted into the cavity body from the through hole;

the head part of the weight body abuts on the upper surface of the cavity body in the inserted state, the neck part is located in the through hole, and the engaging part is located in the internal space;

the engaging part and the neck part can be drawn out from the through hole in the disengaged position;

the engaging part is engaged with an edge of the through hole in the engaged position, so that the engaging part and the neck part cannot be drawn out from the through hole;

the inner surface surrounding the internal space comprises a resistance surface and an abutting surface;

the abutting surface abuts on the engaging part in the engaged position;

when the position is changed to the engaged position from the disengaged position, the resistance surface slides with the engaging part, to apply a rotation resistance; and the engaging part is positioned in a rotating direction by the abutting surface and the resistance surface in the engaged position.

4. The golf club according to claim 3, wherein the angle θ is equal to or less than 90 degrees.

5. The golf club according to claim 1, wherein the cavity body comprises an insertion part inserted into the shaft and a collar part abutting on the end face of the shaft;

a plurality of cavity bodies is provided, which have collar parts having different lengths in an axial direction of the shaft; and one of the plurality of cavity bodies is mounted on the shaft, to enable adjustment of a length of the golf club.

6. The golf club according to claim 1, wherein the cavity body comprises two or more polymers; and the polymers have different complex elastic modulus values.

7. The golf club according to claim 6, wherein the two or more polymers are brought into contact with the shaft; and the two or more polymers are brought into contact with the weight body.

* * * * *